US011499705B1

(12) United States Patent
Wang

(10) Patent No.: US 11,499,705 B1
(45) Date of Patent: Nov. 15, 2022

(54) FLOWER RECEPTACLE WITH WATER LAMP HANDICRAFT

(71) Applicant: Chih-Liang Wang, Tainan (TW)

(72) Inventor: Chih-Liang Wang, Tainan (TW)

( * ) Notice: Subject to any disclaimer, the term of this patent is extended or adjusted under 35 U.S.C. 154(b) by 0 days.

(21) Appl. No.: 17/471,173

(22) Filed: Sep. 10, 2021

(51) Int. Cl.
*F21V 33/00* (2006.01)
*F21S 10/00* (2006.01)

(52) U.S. Cl.
CPC ..... *F21V 33/0028* (2013.01); *F21S 10/002* (2013.01)

(58) Field of Classification Search
CPC ... F21S 10/002; F21S 10/007; F21V 33/0028; G09F 19/18; A47G 7/06
See application file for complete search history.

(56) References Cited

U.S. PATENT DOCUMENTS 1,801,281 A * 4/1931 McEldowney ..... A47G 7/06 215/377
2010/0287750 A1* 11/2010 Randall ..... E04H 13/001 27/1
2014/0268668 A1* 9/2014 Yang ..... G09F 19/02 362/101
2016/0010819 A1* 1/2016 Yang ..... F21S 6/002 362/101

* cited by examiner

*Primary Examiner* — Julie A Bannan
(74) *Attorney, Agent, or Firm* — Leong C. Lei

(57) ABSTRACT

A flower receptacle with a water lamp handicraft, including: a water lamp ornament, where the water lamp ornament includes a water lamp body and a top ornament, and the water lamp body is a hollow and a light-transmissive three-dimensional structure and holds a thick liquid inside, and the top ornament is mounted on the water lamp body; a fixing member, connected to the top ornament, and forming a customized three-dimensional model with the top ornament; and a flower receptacle base, having a tapered structure, mounted on the fixing member, and used for arranging flowers. In the present application, the fixing member and the top ornament are combined, to enable the fixing member and the water lamp ornament to form a unique three-dimensional model.

6 Claims, 3 Drawing Sheets

FLOWER RECEPTACLE WITH WATER LAMP HANDICRAFT

BACKGROUND

Technical Field

The present application relates to the field of flower receptacle technologies, and in particular, to a flower receptacle with a water lamp handicraft.

Related Art

A flower receptacle is a base used for arranging flowers. A base is usually made of a lead block and densely covered with pointed copper nails. There are various styles of bases, for example, a square base, a circular base, and a polygonal base. Flower stems may be inserted on copper nails in various forms to show the artistry of flower arrangement. The term "flower receptacle" was first introduced in the Ming Dynasty. The shape of a flower receptacle includes a spherical shape, a plum blossom tube shape, and a drum shape. The body of a flower receptacle is often decorated with blue-and-white interlocking lotus patterns, gardenias patterns or blue-and-white reverse-painted interlocking lotus patterns. In the Qing Dynasty, flower receptacles continued to be fired, with slight changes in shape and richer varieties, including an imitation Ge glaze, a pink celadon glaze, and a sky-blue glaze. Among them, the flower receptacles fired during the reign of Emperor Yongzheng and Emperor Qianlong were the best, and were called "flower sacs" at that time.

Existing flower receptacles usually have monotonous and conservative structures, while flower arrangement is an artistic activity. With the growing demand for life style, consumers have increasingly high requirements for the structural forms of flower receptacles for flower arrangement. Consumers are more likely to accept and enjoy structural forms of flower receptacles with a sense of design and a sense of art. Therefore, in order to satisfy consumers' pursuit of the sense of design and the sense of art in the structural forms of flower receptacles, it is necessary to continuously design new structures of flower receptacles.

SUMMARY

The objective of the present application is to provide a flower receptacle with a water lamp handicraft having a strong sense of design, a strong sense of art, and a better viewing effect.

In order to solve the above-mentioned technical problem, the present application may be implemented by using the following technical solutions:

A flower receptacle with a water lamp handicraft comprises: a water lamp ornament, comprising a water lamp body and a top ornament, where the water lamp body is a hollow and a light-transmissive three-dimensional structure and holds a thick liquid inside, and the top ornament is mounted on the water lamp body; a fixing member, connected to the top ornament, and forming a customized three-dimensional model with the water lamp body and the top ornament; and a flower receptacle base, having a tapered structure, mounted on the fixing member, and used for arranging flowers.

In an embodiment, the water lamp ornament further comprises a base, the base is arranged at the bottom of the water lamp body, and a control circuit and a light-emitting element electrically connected to the control circuit are arranged inside the base.

In an embodiment, the water lamp ornament further comprises a rotating assembly, and the rotating assembly comprises a driving magnetic rotating member and a driven magnetic rotating member. The driving magnetic rotating member is arranged inside the base and is electrically connected to the control circuit, the driven magnetic rotating member is arranged at the bottom of the water lamp body, and the driving magnetic rotating member drives the driven magnetic rotating member to rotate.

In an embodiment, an ornament and glitter are arranged inside the water lamp body, the ornament is connected to the driven magnetic rotating member, and the glitter is arranged in the liquid.

In an embodiment, the fixing member and the top ornament are mounted and fixed by a connecting member.

In an embodiment, the fixing member and the top ornament are integrally formed.

The beneficial effects of the present application are as follows: In the flower receptacle with a water lamp handicraft disclosed in the present application, the fixing member and the top ornament are combined, to enable the fixing member and the water lamp ornament to form a unique three-dimensional model, and then the flower receptacle base is mounted on the fixing member for arranging flowers, so that the art of flower arrangement is combined with the unique three-dimensional model of the water lamp ornament. Finally, the entire flower receptacle with a water lamp handicraft has a strong sense of design, a strong sense of art, and a better viewing effect, so as to satisfy consumers' pursuit of the sense of design and the sense of art of the structural forms of flower receptacles.

Figure 1:
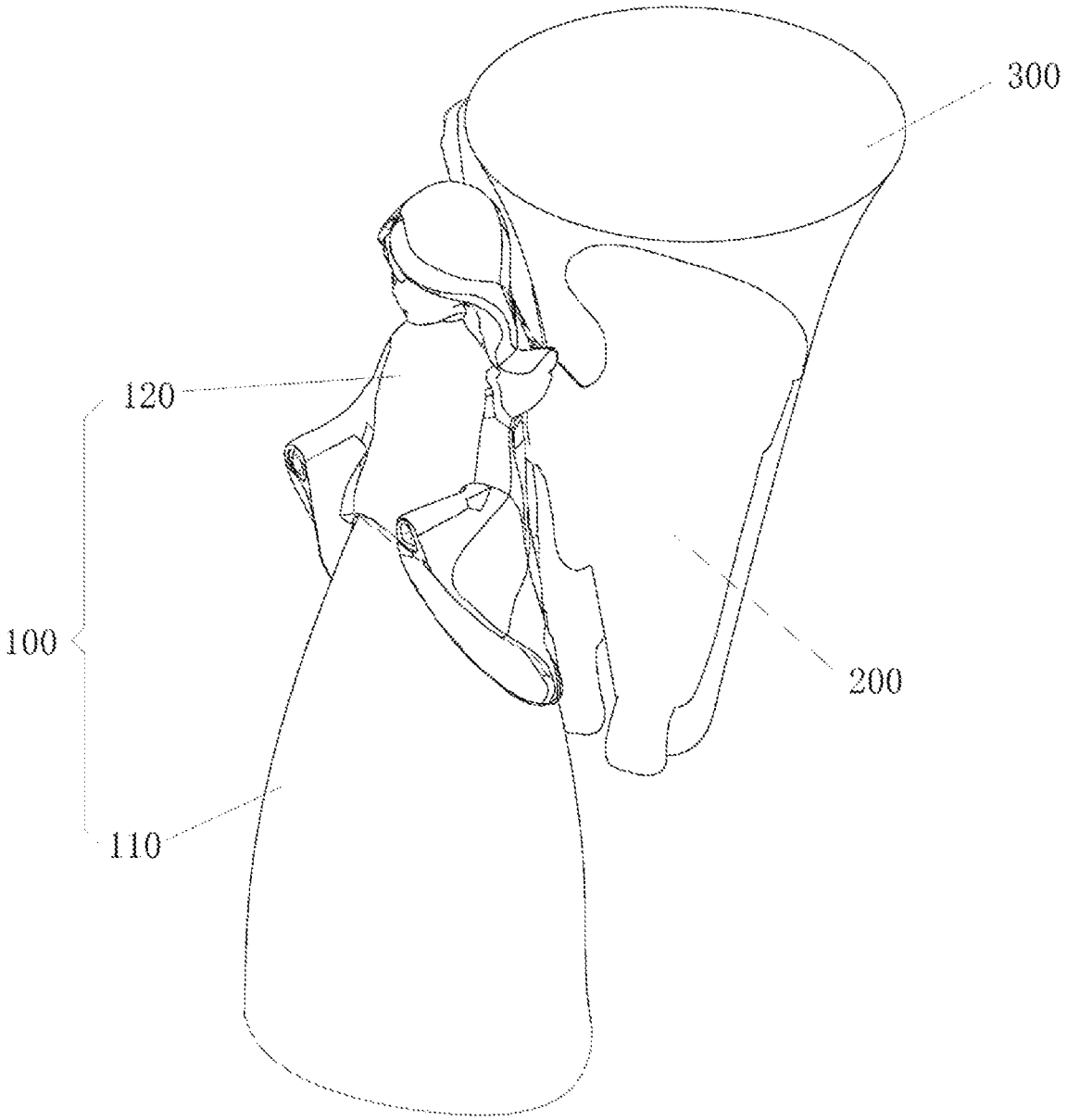
FIG. 1 is a schematic structural diagram 1 of a flower receptacle with a water lamp handicraft according to the present application.

As shown in the drawings: 100. water lamp ornament; 110. water lamp body; 120. top ornament; 130. base; 131. light-emitting element; 140. rotating assembly; 141. driving magnetic rotating member; 142. driven magnetic rotating member; 200. fixing member; 300. base of flower receptacle; 400. ornament; and 500. glitter.

DETAILED DESCRIPTION

To make the foregoing objects, features and advantages of the present application more comprehensible, detailed description is made to specific implementations of the present application below with reference to the accompanying drawings. In the following description, many specific details are described to give a full understanding of the present application. However, the present application may be implemented in many other manners different from those described herein. A person skilled in the art may make similar improvements without departing from the connotation of the present application. Therefore, the present application is not limited to the specific embodiments disclosed below.

It is to be noted that, when a component is referred to as "being fixed to" another component, the component may be directly on the other component, or an intervening component may be present. When a component is considered to be "connected to" another component, the component may be directly connected to the another component, or an intervening component may also be present. In contrast, when a component is referred to as being "directly on" or "directly connected to" another component, there is no intervening component. The terms "vertical", "horizontal", "left", and "right" and similar expressions used in this specification are merely used for the purpose of description.

Unless otherwise defined, meanings of all technical and scientific terms used in this specification are the same as those usually understood by a person skilled in the art to which the present application belongs. In this specification, terms used in the specification of the present application are merely intended to describe objectives of the specific embodiments, but are not intended to limit the present application. The term "and/or" used in this specification includes any and all combinations of one or more related listed items.

Figure 2:
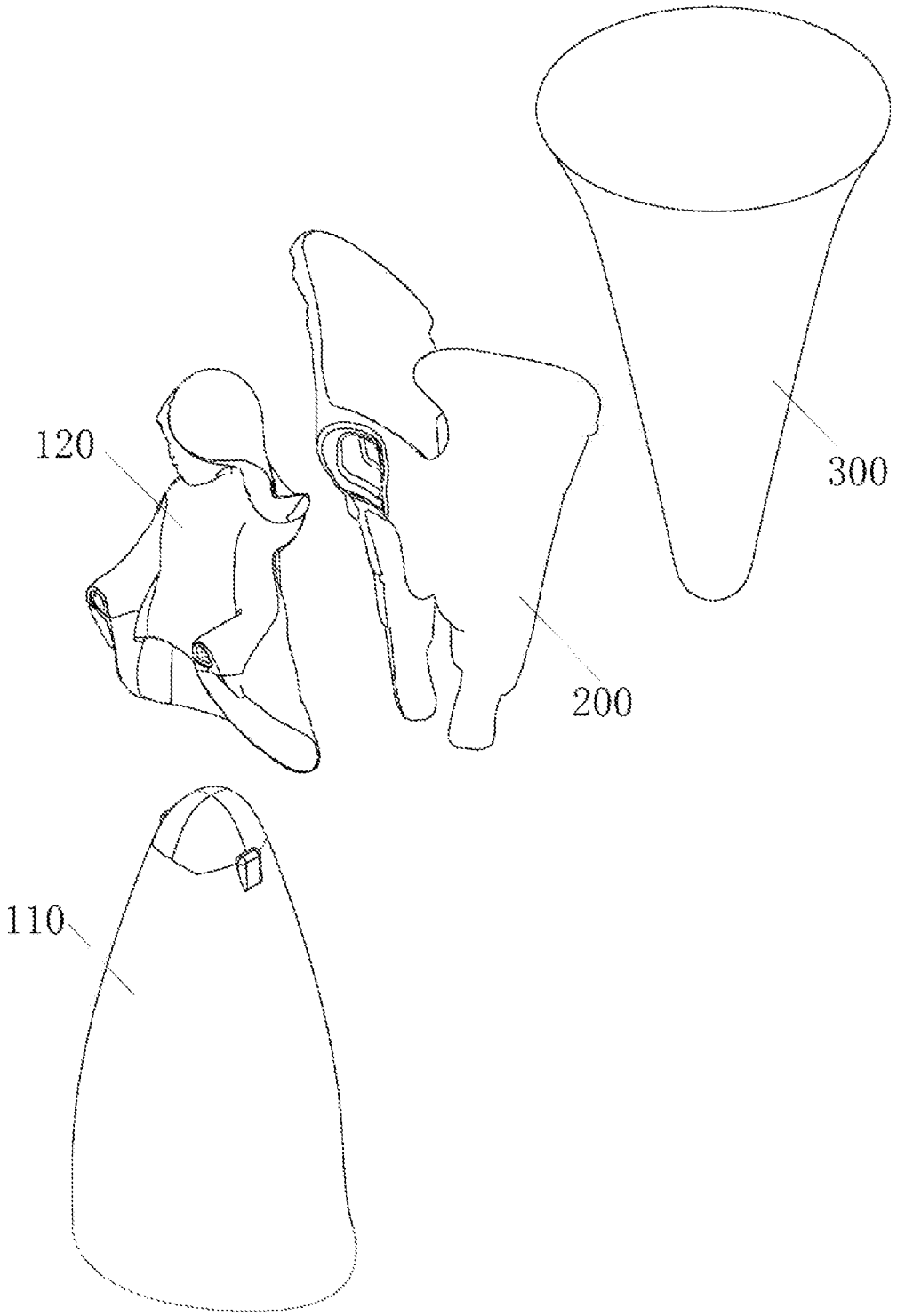
FIG. 2 is a schematic exploded view of a flower receptacle with a water lamp handicraft according to the present application.

Referring to FIG. 1 and FIG. 2, a flower receptacle with a water lamp handicraft includes: a water lamp ornament 100, where the water lamp ornament 100 includes a water lamp body 110 and a top ornament 120, and the water lamp body 110 is a hollow and a light-transmissive three-dimensional structure, holds a thick liquid inside, and the top ornament 120 is mounted on the water lamp body 110; a fixing member 200, connected to the top ornament 120, and forming a customized three-dimensional model with the water lamp body 110 and the top ornament 120; and a flower receptacle base 300, having a tapered structure, mounted on the fixing member 200, and used for arranging flowers.

Specifically, in this embodiment, a flower receptacle with a water lamp handicraft comprises a water lamp ornament 100, a fixing member 200, and a flower receptacle base 300. The water lamp ornament 100 includes a water lamp body 110 and a top ornament 120. The top ornament 120 is mounted at the top of the water lamp body 110. Then the fixing member 200 is connected to the top ornament 120. Finally, the flower receptacle base 300 is clamped on the fixing member 200 to form a flower receptacle structure, so that the flower receptacle has a simple overall structure and reasonable design.

For a strong sense of design and a strong sense of art of the flower receptacle structure, after the water lamp body 110, the top ornament 120, and the fixing member 200 are mounted, various characters, cartoons and other models may be formed. In this embodiment, the flower receptacle structure is formed into an "angel" model, and the fixing member 200 of the flower receptacle structure is wings of the "angel" model. The tapered flower receptacle base 300 is clamped on the fixing member 200 being the wings, and various flowers are arranged in the flower receptacle base 300 to form the art of flower arrangement. Finally, through a combination of the art of flower arrangement with the water lamp ornament 100, the entire flower receptacle with a water lamp handicraft has a strong sense of design and a strong sense of art, and brings a better viewing effect, so as to satisfy consumers' pursuit of the sense of design and the sense of art of the structural forms of flower receptacles.

Figure 3:
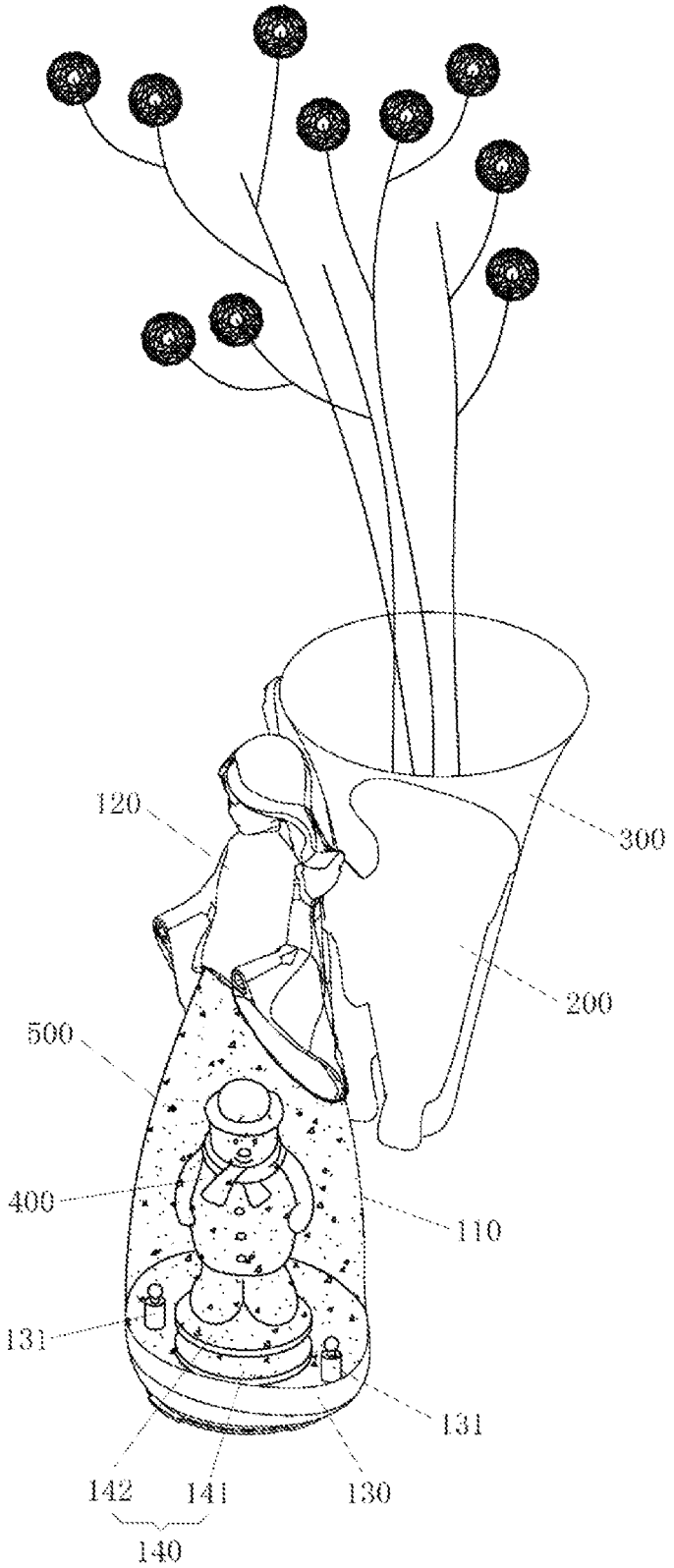
FIG. 3 is a schematic structural diagram 2 of a flower receptacle with a water lamp handicraft of the present application.

Referring to FIG. 3, to enable the flower receptacle with a water lamp handicraft to bring a better viewing effect, the water lamp ornament 100 further includes a base 130, and the base 130 is arranged at the bottom of the water lamp body 110. In addition, a control circuit and a light-emitting element 131 electrically connected to the control circuit are arranged inside the base 130.

After flowers are arranged in the flower receptacle base 300 and form the flower receptacle structure, the light-emitting element 131 emits light through the control circuit. The light may be projected to the water lamp body 110, and then the water lamp body 110 projects the light. In this way, in combination with the flower receptacle structure, the overall flower receptacle with a water lamp handicraft has a strong sense of design and a strong sense of art, thereby improving a viewing effect.

Referring to FIG. 3, similarly, to improve the sense of design and the sense of art of the flower receptacle with a water lamp handicraft, in this embodiment, the water lamp ornament 100 further includes a rotating assembly 140. The rotating assembly 140 includes a driving magnetic rotating member 141 and a driven magnetic rotating member 142. The driving magnetic rotating member 141 is arranged inside the base 130 and electrically connected to the control circuit. The driven magnetic rotating member 142 is arranged at the bottom of the water lamp body 110. The driving magnetic rotating member 141 drives the driven magnetic rotating member 142 to rotate.

In this embodiment, because the water lamp body 110 is the hollow and light-transmissive three-dimensional structure and holds the thick liquid inside, to enable the liquid inside to flow, the driving magnetic rotating member 141 is arranged inside the base 130. The driving magnetic rotating member 141 is a rotating motor and a magnetic turntable. The rotating motor is electrically connected to the control circuit, so that the rotating motor rotates and drives the magnetic turntable to rotate. In addition, the driven magnetic rotating member 142 cooperating with the driving magnetic rotating member 141 is arranged at the bottom water lamp body 110. When the driving magnetic rotating member 141 is rotating, the driven magnetic rotating member 142 is driven to rotate, so as to agitate the liquid in water lamp body 110, to enable the liquid inside to flow. Finally, the overall sense of design, the overall sense of art, and the viewing effect of the flower receptacle with a water lamp handicraft are improved Referring to FIG. 3, certainly, in this embodiment, an ornament 400 and glitter 500 may further be arranged inside the water lamp body 110. The ornament 400 is connected to the driven magnetic rotating member 142. When the driven magnetic rotating member 142 is rotating, the ornament 400 may be driven to rotate. The glitter 500 is arranged in the liquid. When the liquid flows, the glitter 500 is also driven to flow. The glitter 500 may sparkle under the illumination of the light-emitting element 131. In this way, the overall viewing effect of the flower receptacle with a water lamp handicraft is improved.

Referring to FIG. 2, to make it convenient to mount the fixing member 200 and the top ornament 120, the fixing member 200 may be connected to the top ornament 120 by a connecting member. The connecting member may be a screw or a fixing pin, and adopts a split design, to facilitate the replacement of the fixing member 200, so that different three-dimensional models are formed between the water lamp body 110, the top ornament 120 and the fixing member 200.

Certainly, in this embodiment, an integrated structure may also be used for the fixing member 200 and the top ornament 120. The integrated structure can facilitate the production and manufacturing of the fixing member 200 and the top ornament 120 and reduce a production cost.

The foregoing shows and describes basic principles and main features of the present application and advantages of the present application.

What is claimed is:

1. A flower receptacle with a water lamp handicraft, comprising:

a water lamp ornament, comprising a water lamp body and a top ornament, wherein the water lamp body is a hollow and a light-transmissive three-dimensional structure and holds a liquid inside, and the top ornament is mounted on the water lamp body;

a fixing member, connected to the top ornament, and forming a customized three-dimensional model with the water lamp body and the top ornament; and a flower receptacle base, having a tapered structure, mounted on the fixing member, and used for arranging flowers;

wherein the fixing member is connected to the top ornament and the flower receptacle base is clamped on the fixing member to form a flower receptacle structure.

2. The flower receptacle with a water lamp handicraft according to claim 1, wherein the water lamp ornament further comprises a base, the base is arranged at the bottom of the water lamp body, and a control circuit and a light-emitting element electrically connected to the control circuit are arranged inside the base.

3. The flower receptacle with a water lamp handicraft according to claim 2, wherein the water lamp ornament further comprises a rotating assembly, and the rotating assembly comprises a driving magnetic rotating member and a driven magnetic rotating member, the driving magnetic rotating member is arranged inside the base and is electrically connected to the control circuit, the driven magnetic rotating member is arranged at the bottom of the water lamp body, and the driving magnetic rotating member drives the driven magnetic rotating member to rotate.

4. The flower receptacle with a water lamp handicraft according to claim 3, wherein an ornament and glitter are arranged inside the water lamp body, and the ornament is connected to the driven magnetic rotating member, and the glitter is arranged in the liquid.

5. The flower receptacle with a water lamp handicraft according to claim 1, wherein the fixing member and the top ornament are mounted and fixed by a connecting member.

6. The flower receptacle with a water lamp handicraft according to claim 1, wherein the fixing member and the top ornament are integrally formed.

* * * * *